US005627722A

United States Patent [19]

Hirst

[11] Patent Number: 5,627,722

[45] Date of Patent: May 6, 1997

[54] SINGLE HIGH VOLTAGE SUPPLY FOR USE IN A MULTIPLE DEVELOPER ELECTROPHOTOGRAPHIC PRINTER

[75] Inventor: B. Mark Hirst, Boise, Id.

[73] Assignee: Hewlett-Packard Company, Palo Alto, Calif.

[21] Appl. No.: 349,239

[22] Filed: Dec. 5, 1994

[51] Int. Cl.[6] ..... G03G 15/01

[52] U.S. Cl. ..... 361/170; 361/191; 307/39; 399/228

[58] Field of Search ..... 307/38–41, 80, 307/81, 115, 141.4; 361/166–172, 191; 355/326 R, 327

[56] References Cited

U.S. PATENT DOCUMENTS

| | | | |
|---|---|---|---|
| 2,424,243 | 7/1947 | Powell | 361/191 X |
| 3,176,197 | 3/1965 | Hoppe | 361/191 |
| 3,709,594 | 1/1973 | Hastwell | 355/327 |
| 4,769,555 | 9/1988 | Pequet et al. | 307/141 |
| 4,777,379 | 10/1988 | Young | 307/41 |
| 5,121,172 | 6/1992 | Stover | 355/327 |
| 5,376,998 | 12/1994 | Suzuki | 355/326 |
| 5,384,490 | 1/1995 | Swartz, Jr. | 307/41 X |
| 5,424,903 | 6/1995 | Schreiber | 307/166 |

*Primary Examiner*—Fritz Fleming
*Attorney, Agent, or Firm*—Anthony J Baca

[57] ABSTRACT

In order to accomplish the present invention, there is provided a voltage supply system for use in a color electrophotographic printer where the electrophotographic printer has more than one developer. A high voltage AC source receives a select signal that indicates which one of the developers is presently in use. Provided one and only one developer is in use, the alternating current source outputs an AC voltage. A switching network is connected to the HVAC current source and also each developers. The switching network also receives the select signal and routes the AC voltage to the active developer. Stress to the switching elements in the switching network is reduce by proper sequencing of the application and removal of the HVAC and network reconfigurations.

11 Claims, 11 Drawing Sheets

SINGLE HIGH VOLTAGE SUPPLY FOR USE IN A MULTIPLE DEVELOPER ELECTROPHOTOGRAPHIC PRINTER

TECHNICAL FIELD

This invention relates generally to multiple developer electrophotographic printers and copiers. More particularly, to a single high voltage supply for use powering all the developers.

BACKGROUND OF THE INVENTION

With the proliferation of electrophotographic color printers and copying machines, efforts are underway to reduce manufacturing costs. In essence, a color printer is four printers mechanisms working in harmony to create a color output. With the first implementations of color printers, the four printers mechanisms are relatively independent and complete. By making these independent, several subsystems are quadrupled inside the single color printer. One such subsystem is that of the high voltage power supply.

As known in the art electrophotography printing, a high voltage AC power supply is required. By replicating this subsystem four times, one for each developer, the approach is relatively expensive and requires a large space in the printer. Additionally, the plurality of power supplies necessitates multiple calibrations and a large number of components, making it harder to manufacture and not as reliable.

The most common arrangement for these high voltage alternating current power supplies is that of switching power supply. Because the switching frequency of these power supplies is typically within the human audible range, each power supply emits audible noise into the surrounding environment. Therefore, it becomes necessary to somehow contain this sound or reduce it to an acceptable level. By multiplying the number of power supplies necessary to complete the operation of the color printer, the sound reduction process becomes more complicated.

SUMMARY OF THE INVENTION

In order to accomplish the present invention, there is provided a voltage supply system for use in a electrophotographic printer where the electrophotographic printer has a plurality of developers. A high voltage AC source receives a select signal that indicates which one of the plurality of developers is presently in use. Provided one and only one developer is in use, the alternating current source outputs an AC voltage. A switching network is connected to the HVAC current source and also each developers. The switching network also receives the select signal and routes the AC voltage to the active developer.

Stress to the switching elements in the switching network is reduce by proper sequencing of the application and removal of the HVAC and network reconfigurations. First, the HVAC has a delayed turn. A second delay delays the reconfiguration of the switching network when the HVAC voltage is removed.

BRIEF DESCRIPTION OF THE DRAWINGS

A better understanding of the invention may be had from the consideration of the following detailed description taken in conjunction with the accompanying drawings in which.

DETAILED DESCRIPTION OF THE PREFERRED EMBODIMENTS

Figure 1:
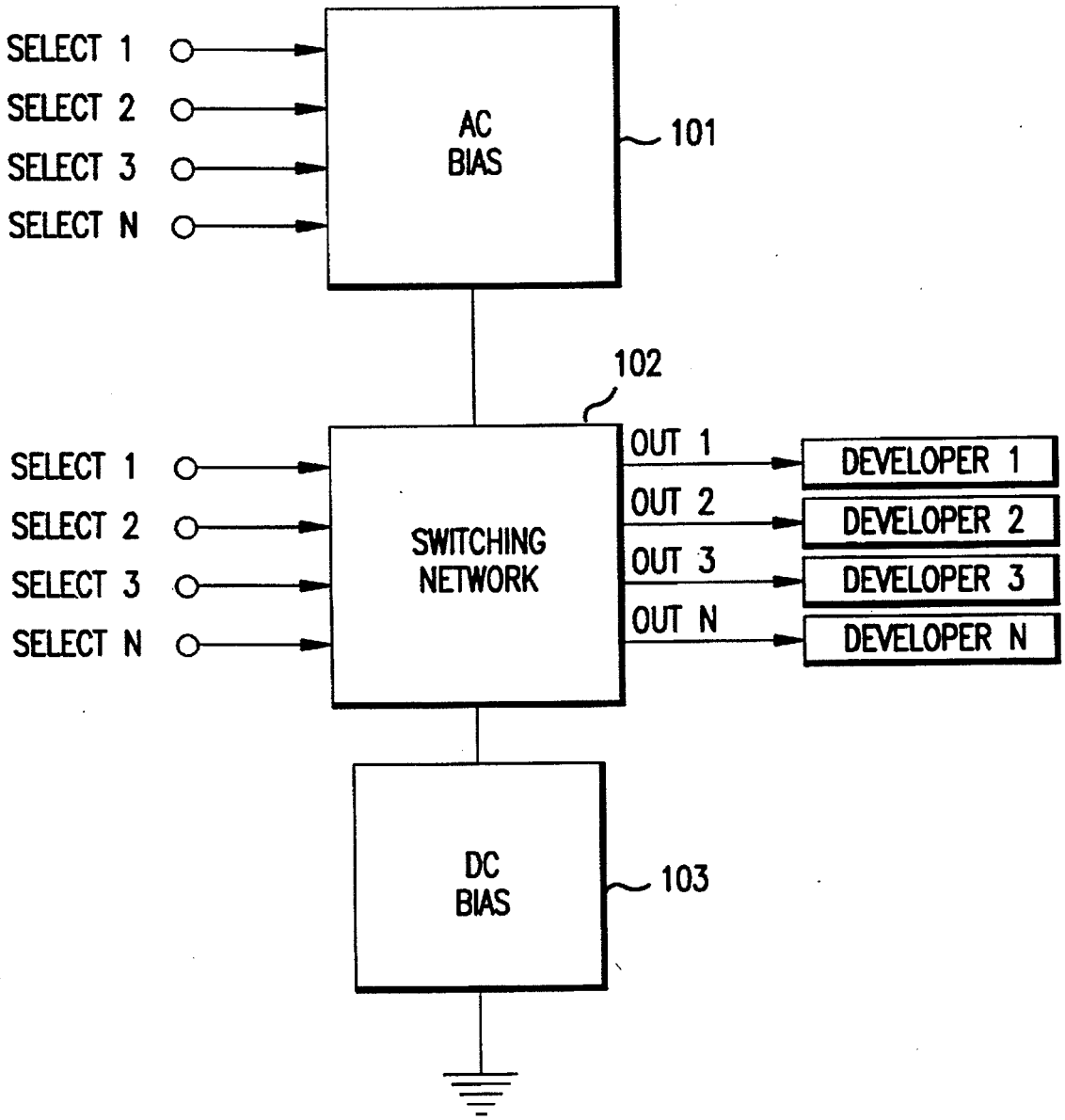
FIG. 1 is high level block diagram in accordance with the present invention.

The present invention is not limited to a specific embodiment illustrated herein. Referring particularly to FIG. 1, there is shown a block diagram in accordance with a preferred embodiment. AC BIAS block 101 receives a plurality of select lines, SELECT 1 through SELECT N. Depending upon the arrangement of the AC BIAS 100 these select lines may either simply enable the AC BIAS, or select a particular bias voltage. Switching Network 102, in accordance with inputs SELECT 1 through SELECT N, route the output of AC BIAS 100 to the appropriate (OUT 1–OUT N) of the switching network. Finally, DC BIAS 103 is used to apply a DC bias to the selected output.

Figure 2:
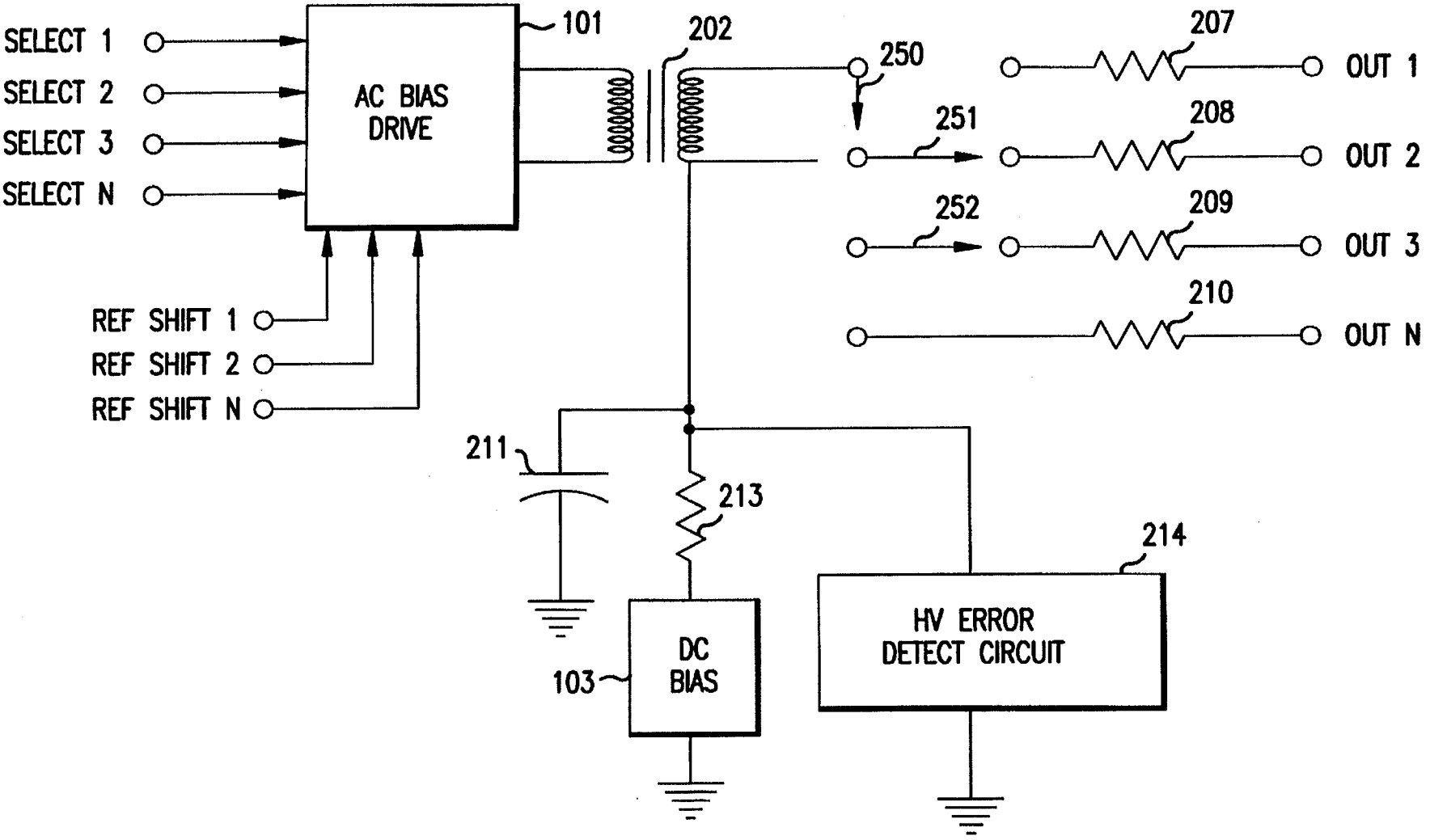
FIG. 2 is a schematic diagram of a preferred embodiment of the switching network.

An embodiment of Switching Network 102 is shown in greater detail in FIG. 2. Here AC BIAS 101 receives SELECT 1 through SELECT N. Additionally, AC BIAS 101 receives REFERENCE SHIFT 1 through REFERENCE SHIFT N which will be described in more detail during the description of the AC BIAS 101. As one skilled in the art would understand, AC BIAS 101 generates an AC signal which is passed through step up transformer 202 to generate the HVAC. Depending upon the arrangement of relays 250, 251, and 252, the output from transformer 202 is routed to one of four (OUT 1–OUT N). Output resistors 207 through 210 are simply meant to limit the amount of current which can be drawn from AC BIAS 101. DC voltage from DC BIAS 103 passes through resistor 213 to bias the selected output. Capacitor 211 provides an AC current path to ground. Finally, a High Voltage Error Detection Circuit 214 is shown. The internal operation of error detection circuit are not important to the understanding of the present invention, and therefore will not be described in detail. One skilled in the art would be able to implement the High Voltage Detection Circuit 214 without undue experimentation.

From FIG. 2 it is clear that the unselected outputs are left floating. If a particular application determines that this condition is not acceptable, the alternative embodiment of FIG. 3 can be used. With this embodiment when an output such as OUT 1 is not selected it is connected to DC BIAS 103 through relay 203*b*. Referring to OUT 2, which is selected, one sees that relay contacts 204*a* are in a "make" position while contacts 204*b* are in the "break" condition. Resistor 204*c* is very large, approximately $10^7$ Ω and is present to give a constant DC path during switching of the AC BIAS. One skilled in the art could easily reconfigure the embodiment of FIG. 3 to provide a non selection short to ground, or leave it floating, instead of DC BIAS 103.

Relays 203, 204, 205, and 206 are energized instantly whereas a time delay is used when turning AC BIAS 101 thus allowing proper sequencing and settling time of these relays. Going in the opposite direction, the AC BIAS turns off instantaneously while the relays de-energize with a time delay.

Figure 3:
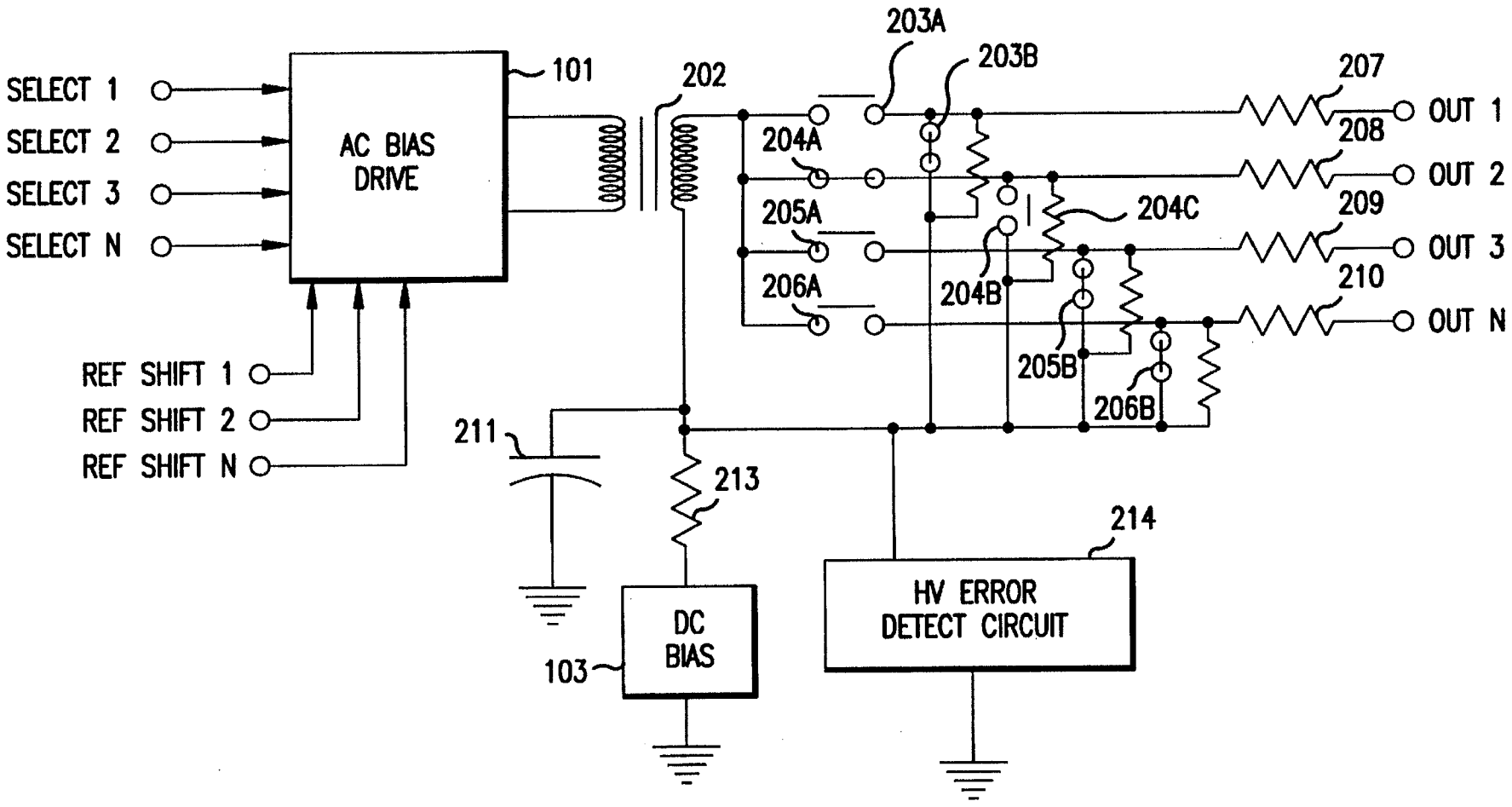
FIG. 3 shows an alternative embodiment of the switching network.
Figure 4:
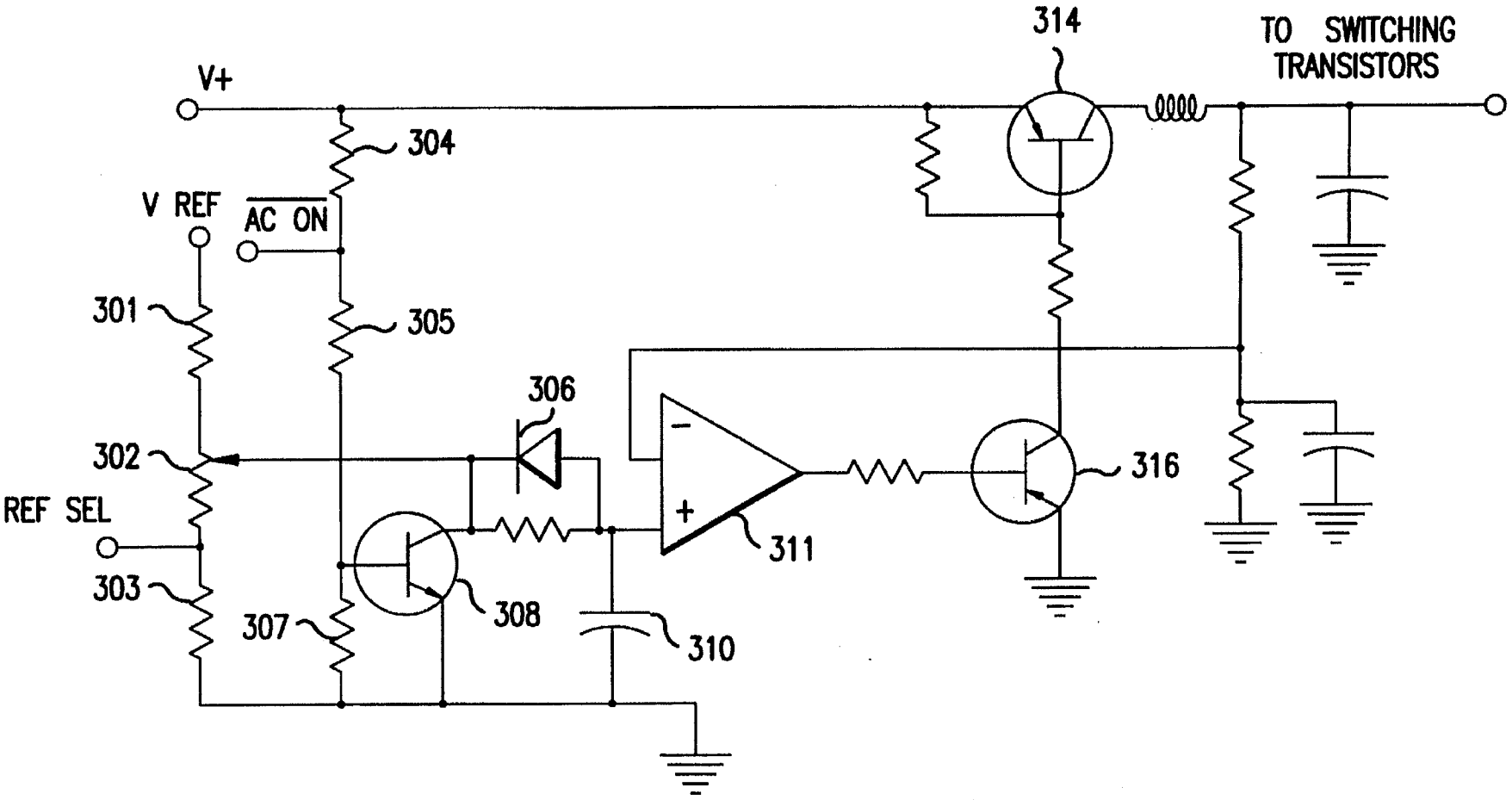
FIG. 4 shows an alternative embodiment of the AC BIAS control.

A portion of AC BIAS 101 is shown in more detail in FIG. 4. OP AMP 311 in conjunction with transistor 316 and pass transistor 314 along with their associated components form a basic voltage regulator The voltage regulator regulates V+ present on the emitter of transistor 314, which is then forwarded to the switching transistors. By adjusting the voltage to the switching transistors the output of transformer 202 of FIG. 3 is directly controlled. Variable resistor 302 is used to initially calibrate the HVAC output. Reference select input at the junction of resistor 302 and resistor 303 is used to change the HVAC output to compensate for changes in the developers.

When $\overline{\text{ACON}}$ at the junction of resistor 304 and resistor 305 is driven low, transistor 308 is turned off. With Q 308's collector now floating, the positive input to OP AMP 311 is allowed to exponentially increase up to the voltage produced at the wiper of resistor 302. The time constant for the exponentially rise in voltage is directly proportional to the capacitance's value of capacitor 310. As understood by one skilled in the art, as the voltage at the non-inverting input of OP AMP 311 rises the output to the switching transistors rises in a proportional manner. Thus, with this embodiment a "soft turn on" is realized.

Once $\overline{\text{ACON}}$ is no longer driven low, the base emitter junction of transistor 308 is allowed to forward bias, thereby driving the transistor 308 into saturation. Now that $V_{CE}$ is at $V_{SAT}$, diode 306 is forward biased providing a low resistance path for the discharge of capacitor 310. This quick discharge of capacitor 310 provides a "instantaneous" shut down of the HVAC. Thus, in summary, the embodiment of FIG. 4 allows for a soft turn on and an instantaneous turn off of the HVAC.

Figure 5:
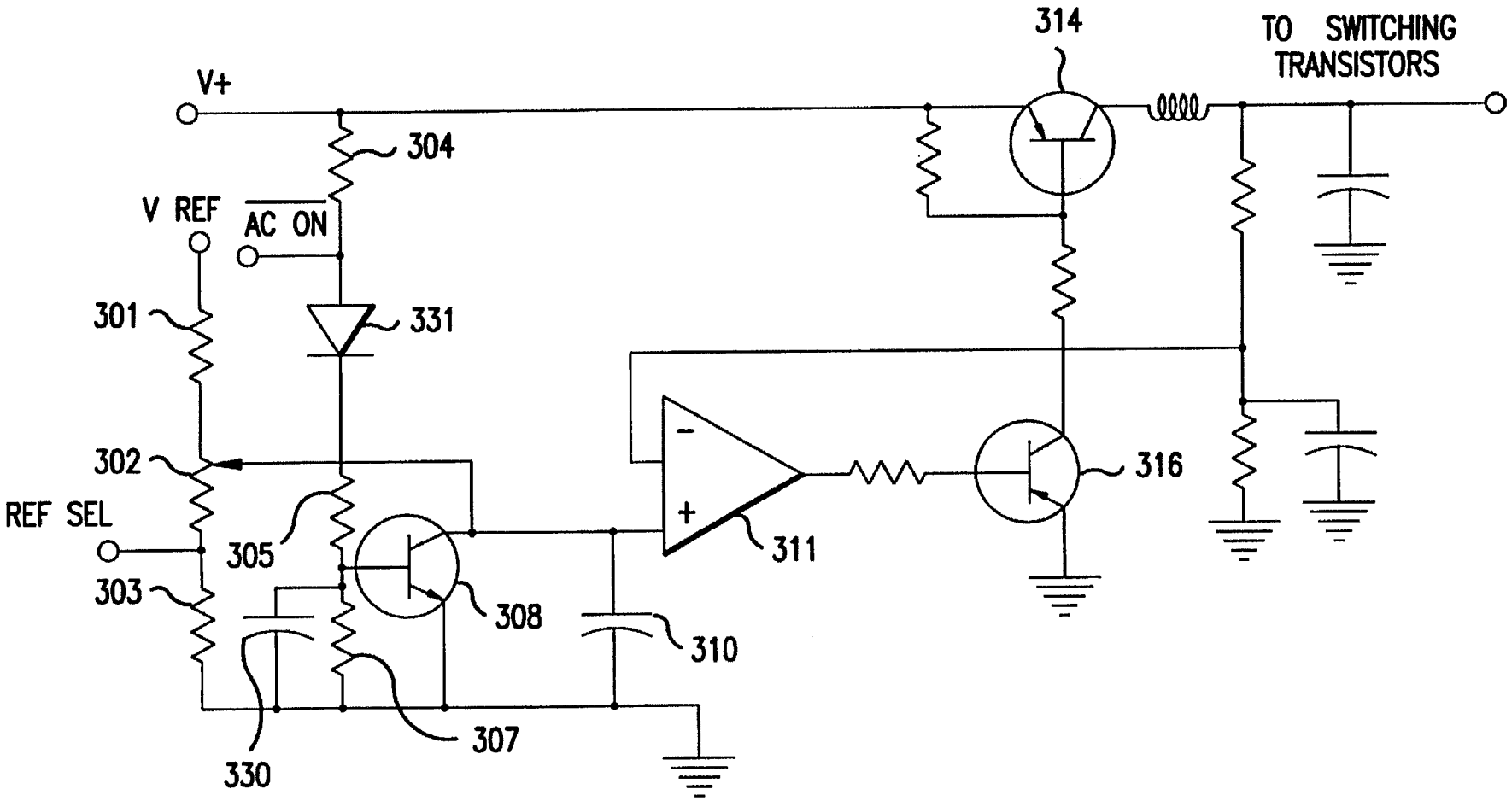
FIG. 5 shows an alternative embodiment of the AC BIAS control.

As just described the circuit of FIG. 4 provided a soft turn on. However, to increase the life expectancy of the relays used in the switching network, it is more desirable to have a delayed turn on in addition to the soft turn on. Such an objective is met by using the circuit of FIG. 5. When $\overline{\text{ACON}}$ is driven low, diode 331 is reversed biased presenting a high impedance path. As such, relatively little current flows through resistor 305 allowing capacitor 330 to discharge through resistor 307. At some point, the base emitter voltage of transistor 308, which is directly proportional to the voltage cross capacitor 330, reduces below that which is necessary to keep transistor 308 in saturation. Once this occurs, the collector of transistor 308 floats allowing capacitor 310 to charge through resistors 302 and 301. Thus, turn on is delayed by the time constant of capacitor 330 and resistor 307 and still exhibits an exponentially rise as determined by capacitor 310. When $\overline{\text{ACON}}$ is no longer driven low, diode 331 becomes forward biased. Capacitor 330 is now charged through resistor 305, eventually driving transistor 308 into saturation. Once transistor 308 is driven into saturation, capacitor 310 "instantaneously" discharges through transistor 308. Thus, turn off characteristics are determined by the time constant as defined by resistor 305 and capacitor 330. Therefore, with this arrangement turn on and turn off delays can be engineered independent of each other.

Figure 6:
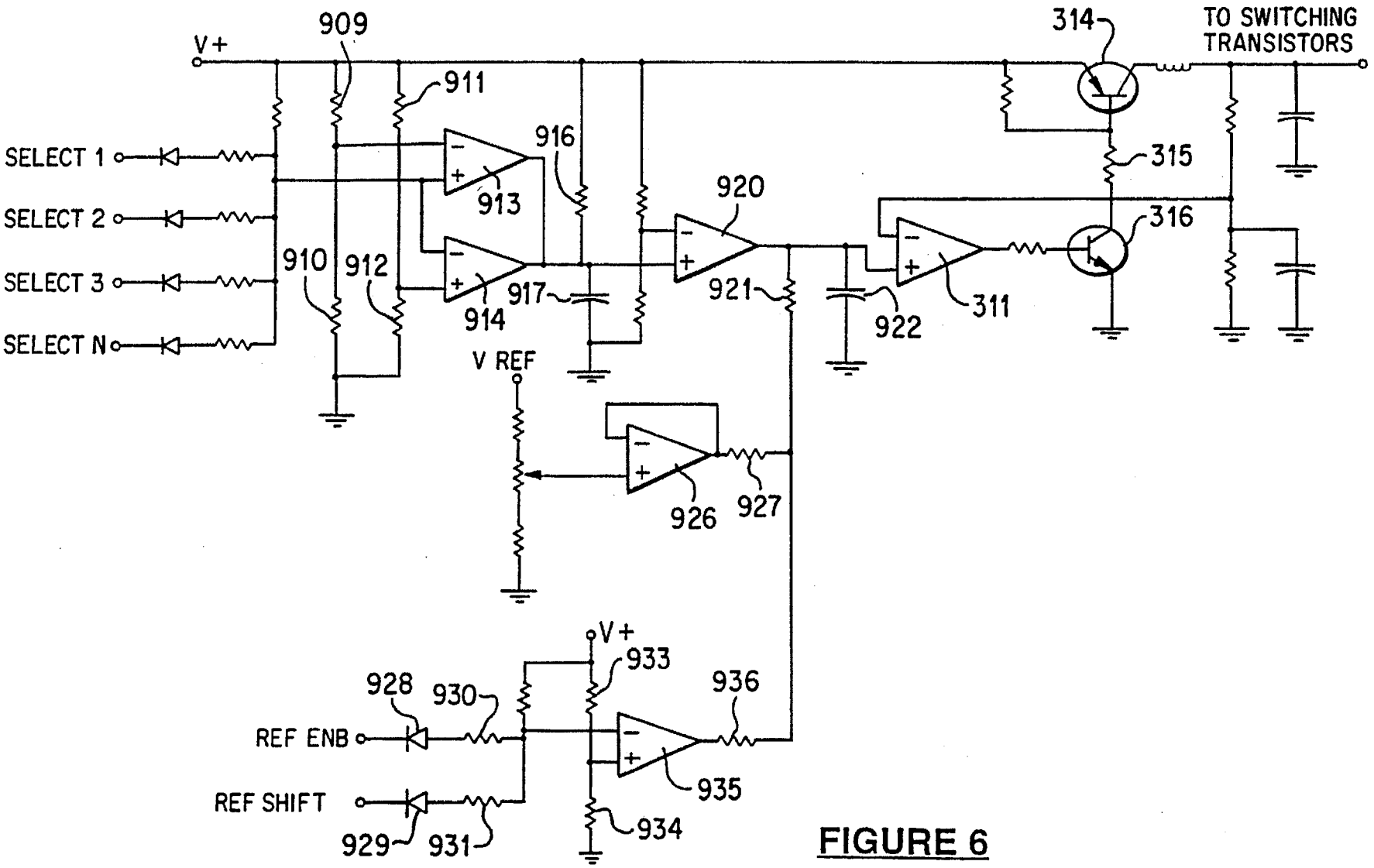
FIG. 6 is a schematic diagram of a preferred embodiment of the AC BIAS control.

FIG. 6 shows a preferred embodiment for controlling the AC BIAS 101. As with the circuit of FIG. 4 and FIG. 50P AMP 311 in conjunction with transistor 316 and 314 operate as a voltage regulator. OP AMP 920, an open collector op amp, operates as a switch to either enable or disable HVAC. OP AMP 926 operating as a voltage follower provides a stable, buffered voltage reference at its output. OP AMP 935, an open collector op amp, provides a means in which the voltage reference can be changed to compensate for aging of the photoconductor drums. OP AMPS 913 and 914, both of the open collector type, operate as a window comparator that operates when one and only one of the select lines are low. With that brief high level description of the circuit a more detailed description will follow.

Assuming that OP AMP 920 is enabled, the non-inverting input to OP AMP 311 is allowed to reach the voltage reference as output by OP AMP 926. During the initial stages of energizing the HVAC capacitor 922 charges through resistors 927 and 921. This charging requirement produces the desired ramp up in the high voltage power supply, (i.e., soft start).

As mentioned before, it may be desirable to adjust the HVAC to compensate for aging effects in the developer. OP AMP 935 in combination with resistor 936 provide a means of selecting one of two output voltages. Here, OP AMP 935 operates as a comparator, thus when the voltage at the inverting input is greater than the voltage at the non-inverting input, the output of 935 approaches zero. For inputs where the non-inverting input is greater than the inverting input, the output of OP AMP 935 floats. By proper selection of resistors 930 through 934 the inverting input to OP AMP 935 will remain at a voltage greater than the non-inverting input unless both REFERENCE SELECT ENABLE and REFERENCE SHIFT 1 are driven low. Thus, diode 928 and 929 in combination with resistor 930 and 931 operate as an AND gate.

Assuming both REFERENCE SELECT ENABLE and REFERENCE SHIFT are forced low, the voltage on the inverting input is less than the voltage on the non-inverting input for OP AMP 935. Once this occurs, the output of OP AMP 935 approaches zero, forming a voltage divider with resistor 936 and resistor 927. By proper selection of these two resistors, the reference voltage is reduced by the desired amount.

OP AMPS 913, 914, and 920 in combination perform the enable operation. OP AMPS 913 and 914 are configured as a window comparator. A window comparator, as known in the art, provides an indication when the input voltage is below a maximum and above a minimum. As shown in FIG. 6 the maximum voltage is defined by the ratio of resistor 911 to 912 while the minimum is defined by the ratio of resistor 909 to 910. By proper selection of resistors 909 through 912, the desired operation of the window comparator is achieved. In particular, it is desirable with the present embodiment that when no select line is active, OP AMP 914 is turned on. When one and only one of the select lines are active both OP AMP 913 and 914 are turned off. Finally, when more than one of the select lines are enabled OP AMP 913 is turned on.

When either OP AMP 913 or 914 are turned on, capacitor 917 discharges through the turned on op amp. As capacitor 917 discharges the non-inverting input to OP AMP 920 becomes less than the inverting input, thereby switching on OP AMP 920. Once OP AMP 920 is switched on capacitor 922 is allowed to discharge through OP AMP 920 turning off power to the switching transistors. Because the discharged path of both capacitor 917 and capacitor 922 is through a relatively low resistance path, turn off is "instantaneous."

When one of the select lines are forced low, both OP AMPS 913 and 914 outputs are allowed to float. Capacitor 917 charges through resistor 916. At some point the non-inverting input to OP AMP 920 becomes greater than the inverting input, turning off OP AMP 920. Capacitor 922 now charges through resistor 927 and 921. Thus an initial delay as defined by capacitor 917 and resistor 916 produce a delayed turn on, while the time constant of capacitor 922 and resistor 921 and 927 produce an "soft turn on".

Figure 7:
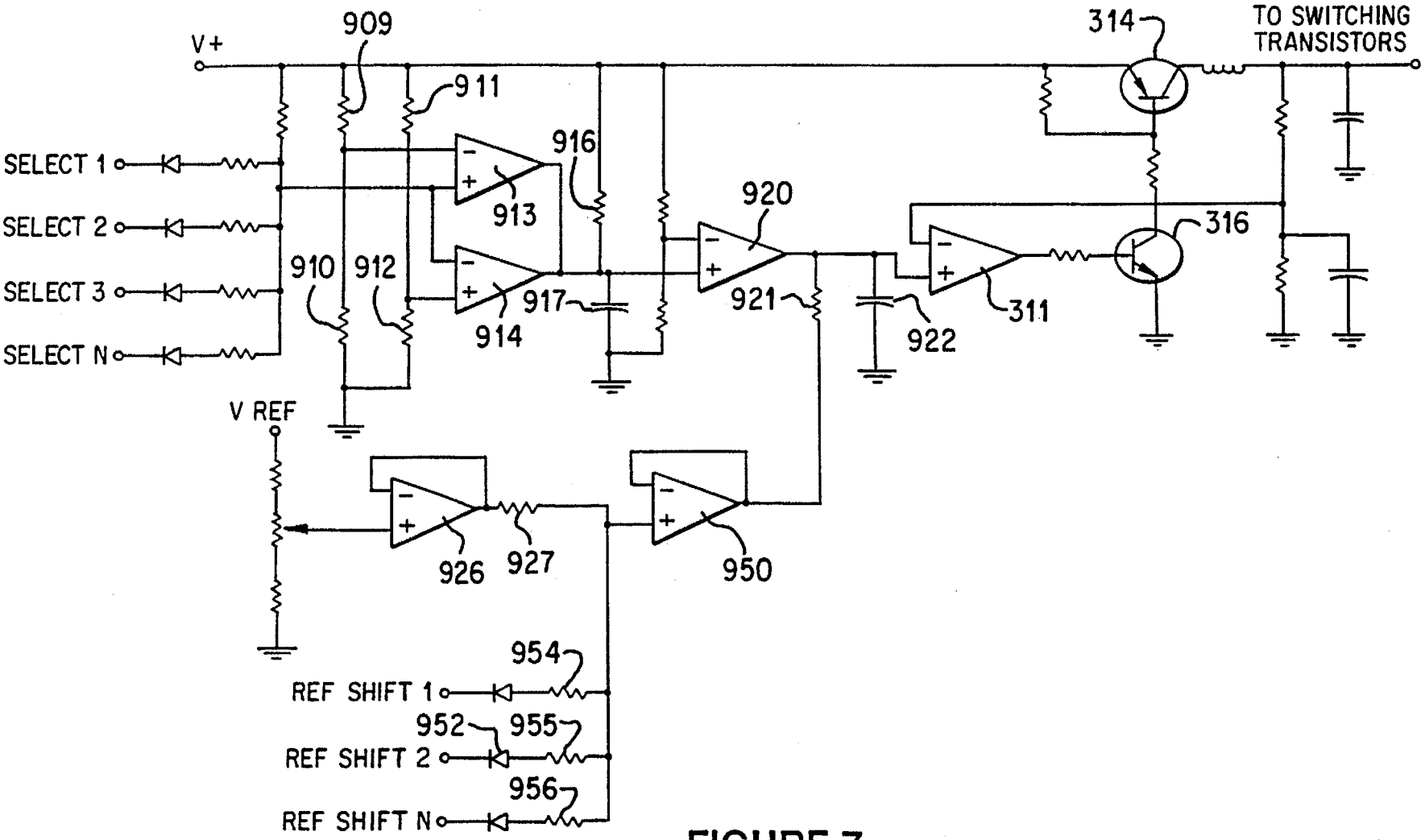
FIG. 7 shows an alternative embodiment of the AC BIAS control.

As described, one limitation, of the circuit of FIG. 6 is the limited number of reference selects. Using the alternative embodiment of FIG. 7, the number of reference selects can be increased to fit the requirement. By rearranging OP AMP 926, a plurality of output voltages can be selected. By way of an example, if REFERENCE SHIFT is active, diode 952 is forward biased. With diode 952 now forward biased resistor 955 and resistor 927 form a voltage divider. Thus, by proper selection of resistors 954 through 956 in relation to resistor 927, a plurality of HVAC's can be selected by applying the proper code to the reference select. One skilled in the art will realize that numerous embodiments for achieving this result are possible and that FIG. 7 is simply one of those embodiments.

Figure 8:
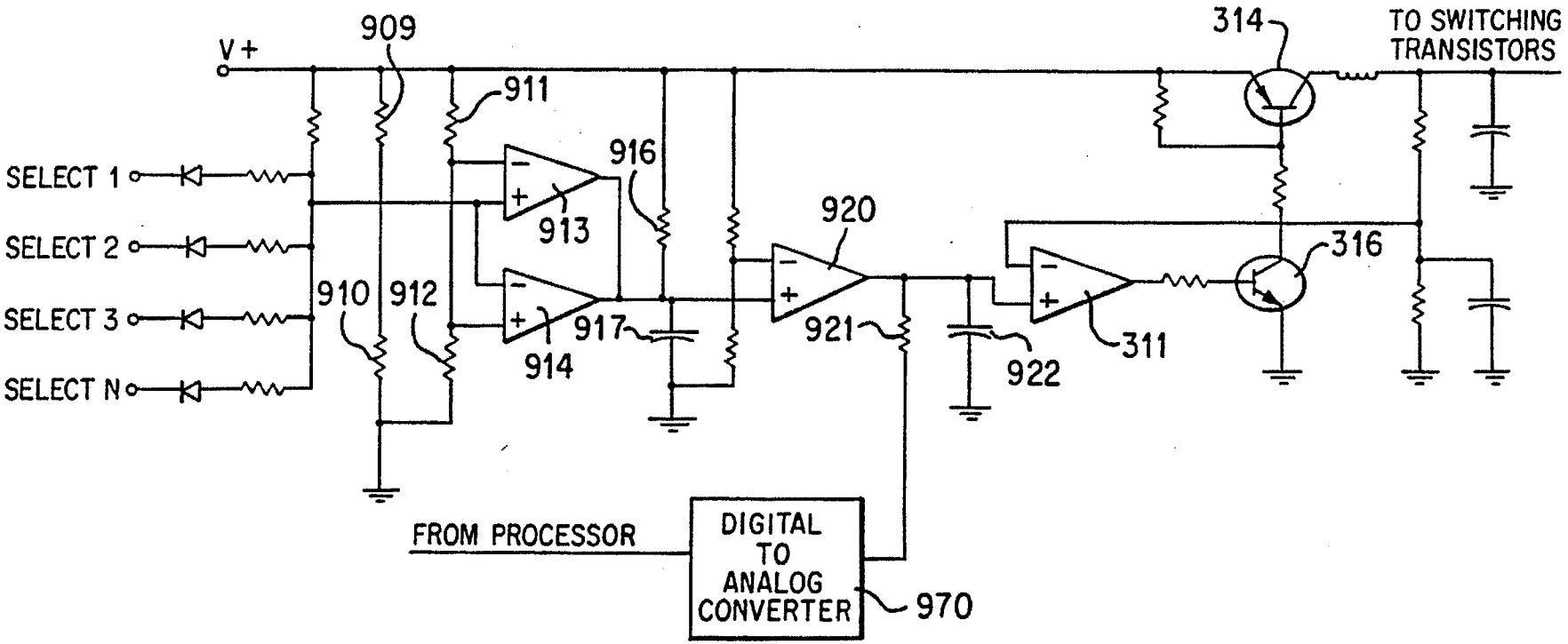
FIG. 8 shows an alternative embodiment of the AC BIAS control.

Finally for maximum versatility the voltage reference generator can be replaced by D/A CONVERTER 970 as shown in FIG. 8. With the D/A CONVERTER 970 it may also be possible to eliminate the on off circuit as implemented with op amps 913, 914 and 920. In operation, the attached processor sends a digital code to the D/A CONVERTER 970. As is understood by one skilled the art, D/A CONVERTER 970 outputs a voltage as defined by the digital code. By programming D/A CONVERTER 970 to output zero volts, the HVAC is turned off. During turn on, the processor can keep D/A CONVERTER 970 at zero volts long enough to allow the switching element in the switching network time to settle. After this delay, the processor slowly increases the output voltage from D/A CONVERTER 970, thus providing a soft turn on.

If less processor interventions is desired, the soft turn on can be accomplished by using RC circuit. In particular, D/A CONVERTER 970 is connected through a series resistor 921 to OP-AMP 311. A capacitor is connected from the input of OP-AMP 311 to ground. With this arrangement, after the delay the processor programs D/A CONVERTER 970 to the desired voltage. The RC (921+922) combination causes an exponentially increase in the reference voltage provided to OP-AMP 311, which in turn the HVAC follows in proportion.

Timing during turn off can also be easily controlled if D/A CONVERTER 970 is used. The processor first programs D/A CONVERTER 970 to output zero volts thereby turning off the HVAC. After the appropriate time delay, the processor reconfigures the switching network.

Figure 9:
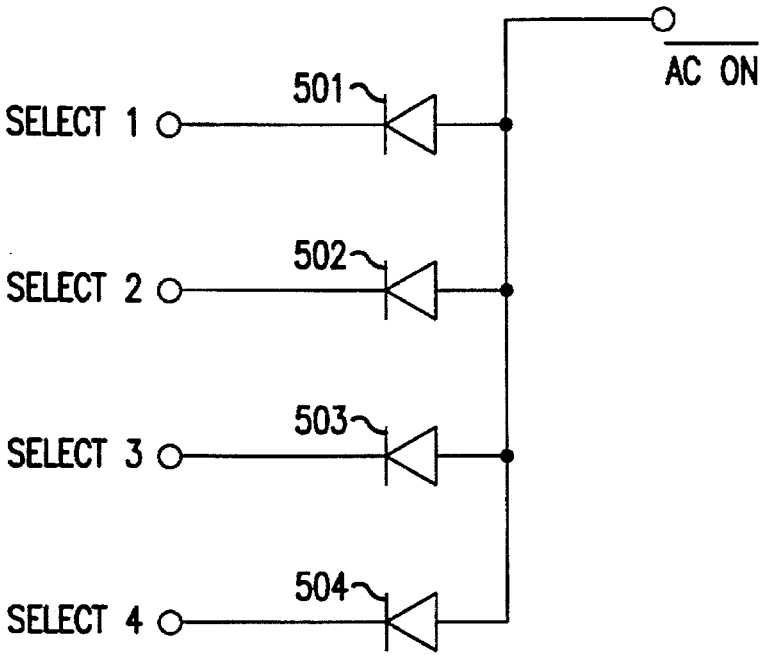
FIG. 9 illustrates the $\overline{\text{ACON}}$ control logic.
Figure 10:
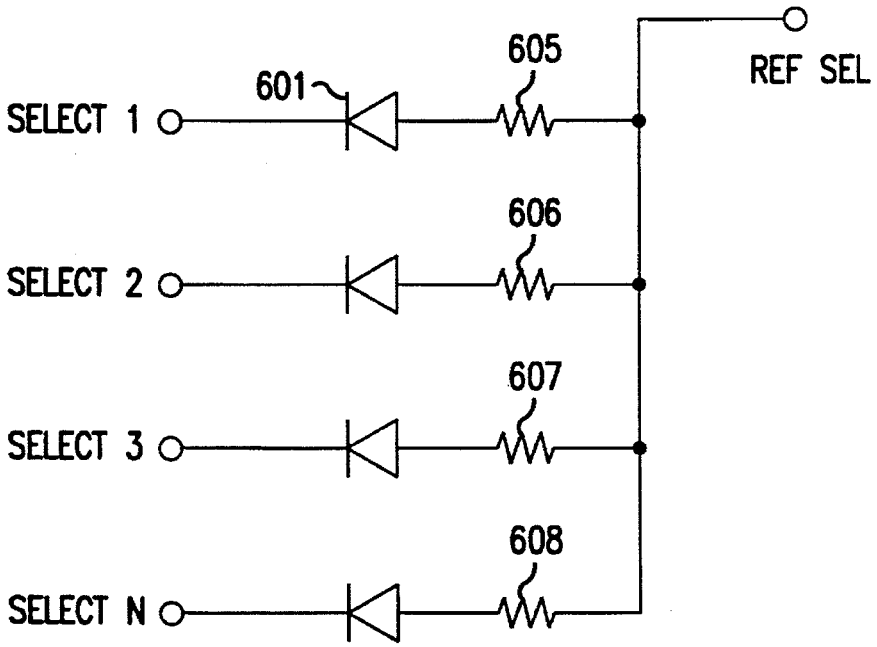
FIG. 10 is a schematic diagram of the preferred REF SELECT logic.

Assuming there are individual signals indicating which one of a plurality of developers are being selected at any given time, the appropriate control signals necessary for the proper operation of the AC BIAS circuit 101 and Switching Network 102 can be accomplished with simple diode resistor logic as will be described in FIGS. 9 through 13. Referring first to FIG. 9, by using diodes 501 through 504, whenever one of the select lines is driven low, $\overline{\text{ACON}}$ will also be driven low. As described above for FIGS. 4 and 5, $\overline{\text{ACON}}$ then enables or disables the HVAC circuit. The circuit of FIG. 10 operates in a similar manner to that of FIG. 9 however, this circuit is used to shift the AC BIAS 101 output depending upon which select line is active. As arranged, when a particular select is enabled, for example SELECT 1, the associated diode, here 601, is forward biased. This in essence places resistor 605 in parallel with resistor 303. This parallel combination, therefore, reduces the voltage on wiper arm of resistor 302. Thus, if each developer requires the same high voltage, resistors 605 through 608 can be of equal size. However, if on the other hand, each developer requires a different HVAC this too can be compensated by proper selection of resistors 605 through 608 and resistor 303.

Figure 11:
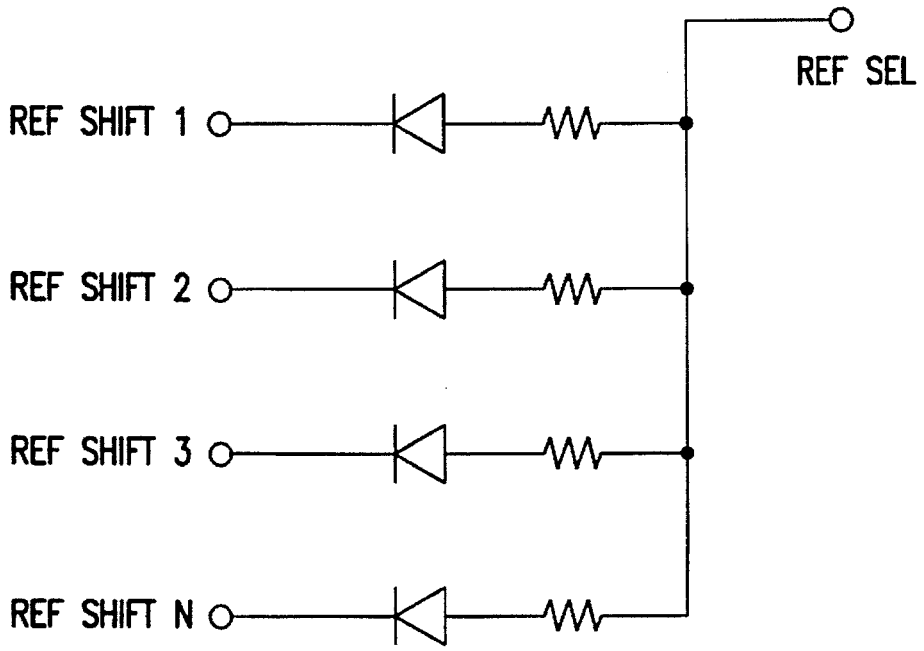
FIG. 11 is a schematic diagram of the REF SHIFT logic.
Figure 12:
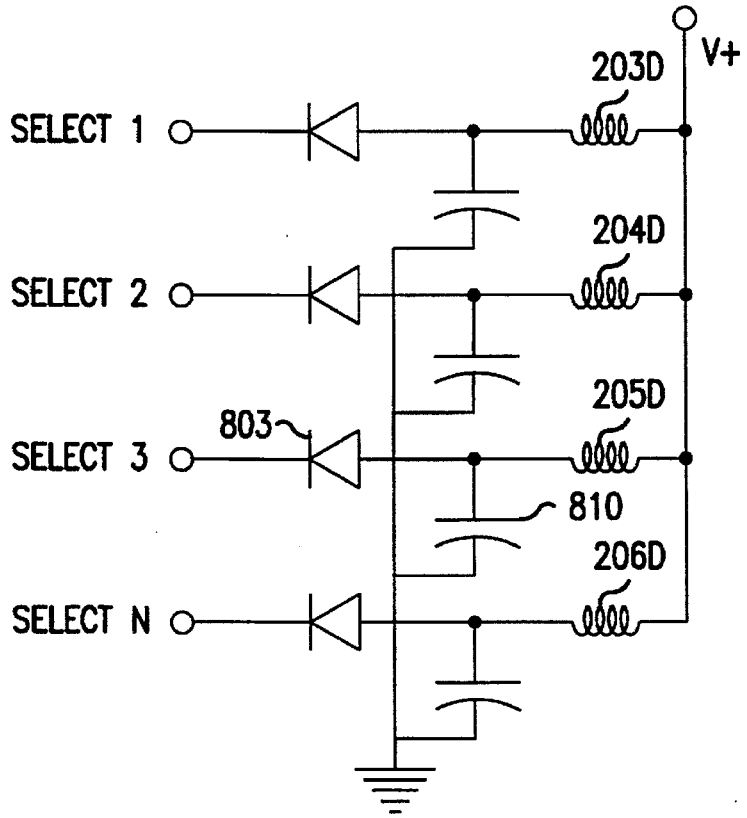
FIG. 12 is a schematic diagram of the relay control logic.

It has been determined that the HVAC may need to be adjusted to compensate for aging effects of the photoconductor drum or the developers. To allow for this the present invention provides a means to select a plurality of output voltages independent of the developer currently being used. FIG. 11 shows one such embodiment for accomplishing this objective. The circuit of FIG. 11 operates in parallel and identical to that of FIG. 10.

Figure 13:
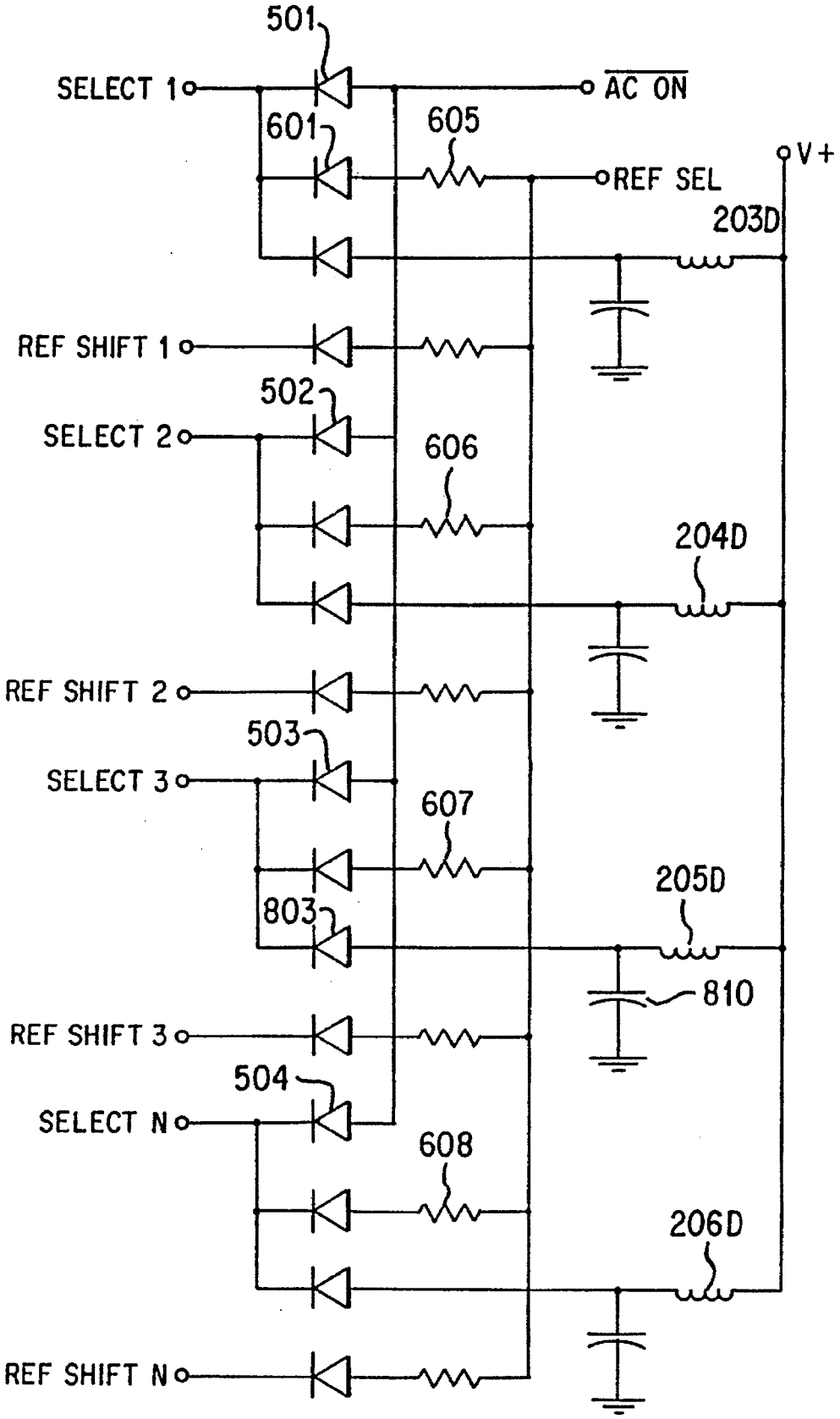
FIG. 13 shows the combination of the control circuits as illustrated in FIGS. 9 and 12.

Finally, the appropriate relays for the Switching Network 102 must be energized in accordance with the selected developer. A circuit of FIG. 12 allows for "instantaneous" energizing of the selected relay, with a delayed release. For example, if SELECT 3 is active, diode 803 becomes forward biased allowing current to pass through relay coil 205D thereby energizing relay 205A and 205B of FIG. 3. When SELECT 3 returns back to a high level diode 803 becomes reverse biased allowing relay coil 205D to discharge through capacitor 810. Thus, by proper sizing of capacitor 810 the release delay of relay 205D can be controlled. Similarly, relay coils 203D, 205D, and 206D control relay contacts 203A, 203B, 205A, 205B, 206A, and 206B of FIG. 3 respectively. FIG. 13 shows the complete collection into one circuit of all the control functions previously described in FIGS. 9 through 12. As shown, the circuit uses 16 diodes. While diodes are relatively inexpensive, a less expensive implementation of the control circuit may be possible.

Although the preferred embodiment of the invention has been illustrated, and that form described, it is readily apparent to those skilled in the art that various modifications may be made therein without departing from the spirit of the invention or from the scope of the appended claims.

What is claimed is:

1. A voltage supply system for use in a electrophotographic printer where said electrophotographic printer has a plurality of developers, said system comprising:

an alternating current source, said alternating current source receives a plurality of select signals for indicating which one of said plurality of developers is in use, said alternating current source outputs an AC voltage when one of said plurality of developers is active; and a switching network connected to said alternating current source and connected to said plurality of developers, said switching network receives said plurality of select signals and routes said AC voltage to the active developer.

2. The voltage supply system of claim 1 further comprising:

a first delay means for delaying said output of said AC voltage; and a second delay means for delaying reconfiguration of said switching network when said AC voltage is removed.

3. The voltage supply system of claim 1 wherein said switching network comprising:

a first relay having a first position and a second position, said first position routes said AC voltage from said alternating current source to a first one of said plurality of developers, said second position routes said AC voltage to a second relay;

said second relay, having a first position and a second position, said first position routes said AC voltage from said said first relay to a second one of said plurality of developers, said second position routes said AC voltage to subsequent developers.

4. The voltage supply system of claim 1 wherein said alternating current source comprising:

a variable reference source connected to said plurality of select signals, said variable reference source generates a reference voltage when one of said plurality of developers is active; and an adjustable power supply connected to said variable reference source, said adjustable power supply generates said AC voltage relative to said reference voltage.

5. The voltage supply system of claim 4 wherein said reference voltage is adjustable for each of said plurality of developers.

6. The voltage supply system of claim 5 wherein said reference voltage is adjustable independent of which one of said plurality of developers is active.

7. A voltage supply system for use in an electrophotographic printer where said electrophotographic printer has at least two developers, said system comprising:

a select means for generating a signal indicating which one of said at least two developers is in use;

an alternating current source connected to said select means, said alternating current source outputs an AC voltage when one of said at least two developers is in use; and a switching network connected to said alternating current source, said select means, and to each of said at least two developers, in accordance with said signal indicating which one of said at least two developers from said select means, said switching network passes said AC voltage to said developer in use.

8. The voltage supply system of claim 7 wherein said alternating current source outputs a different AC voltage depending which developer is in use.

9. The voltage supply system of claim 7 further comprising:

a reference select means for adjusting said AC voltage independent of which developer is in use.

10. The voltage supply system of claim 7 further comprising:

a first delay means for delaying said output of said AC voltage; and a second delay means for delaying reconfiguration of said switching network when said AC voltage is removed.

11. The voltage supply system of claim 7 wherein said switching network further comprising:

a relay having a first position and a second position, said first position routes said AC voltage from said alternating current source to a first one of said at least two developers, said second position routes said AC voltage from said alternating current source to a second one of said at least two developers, said relay selecting said first position in response to said select means indicating said first one of said at least two developers is in use and selecting said second position in response to said select means indicating said second one of said at least two developers is in use.

* * * * *